US005314713A

United States Patent [19]

Mori et al.

[11] Patent Number: 5,314,713

[45] Date of Patent: May 24, 1994

[54] METHOD FOR PRODUCING RECORDING MEDIUM

[75] Inventors: Takahiro Mori; Hiroshi Sato, both of Yokohama, Japan

[73] Assignee: Canon Kabushiki Kaisha, Tokyo, Japan

[21] Appl. No.: 3,852

[22] Filed: Jan. 11, 1993

Related U.S. Application Data

[63] Continuation of Ser. No. 611,538, Nov. 13, 1990, abandoned.

[30] Foreign Application Priority Data

Nov. 14, 1989 [JP] Japan ..... 1-293900
Aug. 14, 1990 [JP] Japan ..... 2-213697
Sep. 6, 1990 [JP] Japan ..... 2-234604

[51] Int. Cl.[5] ..... B41M 3/12

[52] U.S. Cl. ..... 427/152; 427/146; 427/336; 427/384; 427/385.5

[58] Field of Search ..... 427/146, 152, 336, 384, 427/385

[56] References Cited

U.S. PATENT DOCUMENTS 2,702,254 2/1955 Dowd ..... 427/336
3,440,083 4/1969 Fleming et al. ..... 427/336
4,304,626 12/1981 Shaw ..... 427/336
4,550,053 10/1985 Arai et al. ..... 428/304.4
4,783,376 11/1988 Sakaki et al. ..... 428/511
4,954,395 9/1990 Hasegawa et al. ..... 428/318.4

FOREIGN PATENT DOCUMENTS 57-173194 10/1982 Japan .
59-174382 10/1984 Japan .

OTHER PUBLICATIONS

Patent Abstracts of Japan, vol. 9, No. 38 (M-358) [1761]; JP-A-59-178290, Oct. 9, 1984.

*Primary Examiner*—Janyce Bell
*Attorney, Agent, or Firm*—Fitzpatrick, Cella, Harper & Scinto

[57] ABSTRACT

A recording medium having a substrate and an ink-receiving layer formed on the substrate is provided by (a) dissolving a plurality of organic compounds in a first solvent which is a good solvent in common for all of the organic compounds to form a solution, applying the solution onto a substrate and evaporating the first solvent off to form an ink-receiving layer, and then (b) applying onto the ink-receiving layer a second solvent which is a poor solvent for at least one of the organic compounds and is a good solvent for the rest of the organic compounds and evaporating the second solvent off.

28 Claims, No Drawings

METHOD FOR PRODUCING RECORDING MEDIUM

This application is a continuation of application Ser. No. 07/611,538 filed Nov. 13, 1990, now abandoned.

BACKGROUND OF THE INVENTION

Field of the Invention

The present invention relates to a method for producing a recording medium such as ink jet recording paper. More particularly, the present invention relates to a method for producing a recording medium onto which a large amount of ink is to be applied per unit area such as in full color image formation at a high density and a high speed, the recording medium being superior in ink adsorptivity and anti-blocking property, exhibiting extremely little curling, and giving stable images even after long-time storage under a high humidity condition.

Related Background Art

Ink jet recording is noticed because of its less noise generation, and suitability for high speed printing and multicolor printing.

Recording mediums conventionally used for ink jet recording include usual papers, recording mediums called ink jet recording papers having a porous ink-receiving layer provided on a base material, and transparent OHP recording mediums.

In recent years, as the result of improvement in performance of ink jet recording apparatuses as enabling high-speed and multi-color recording, the recording mediums therefor are required to have further improved characteristics in various items.

In particular, light-transmissive recording mediums for ink jet recording need to satisfy simultaneously the basic requirements such as 1) high light-transmissivity,
2) high ink absorbency,
3) large dot size,
4) high optical density (OD) of a dot, even full dot,
5) superior anti-blocking property,
6) no occurrence of beading.

The "beading" herein is a phenomenon of localization of a large amount of ink at the surface of an ink-receiving layer to cause non-uniform density.

In particular, the beading phenomenon is significantly observed in such cases as using droplets of large ink capacity, as using a high frequency of ink-droplet ejection, or as using droplets in plurality of colors as in color recording, which makes difficult the formation of precise images.

The anti-blocking property is required in the cases where a large amount of ink is applied on a recording medium at the same time, for example, in use of a recording head having a plurality of ink ejection openings (nozzles) and in formation of full color images by use of inks in a multitude of colors. The resin in an ink-receiving layer having absorbed a large amount of ink swells or dissolved to cause stickiness, and sticks to paper, a plastic film, etc. Such sticking phenomenon is called "blocking". The property of causing no blocking even in application of a large amount of ink onto a recording medium is called "anti-blocking property".

Various investigation have been made to meet the above-mentioned requirements. However, no recording medium is known at present which satisfies all the requirements, even though a certain degree of achievement has been made.

For an ink-jet recording medium using aqueous ink for recording, conventionally used are hydrophilic natural resins such as albumin, gelatin, casein, starch, cationized starch, gum arabic, sodium alginate, and the like; water-soluble or hydrophilic synthetic resins such as polyvinyl alcohol, cationized polyvinyl alcohol, polyamides, polyacrylamide, polyvinylpyrrolidone, quaternized polyvinylpyrrolidone, poly(N-vinyl-3-methylpyrrolidone), polyvinylimidazole, polyallylamine, polyallylamine hydrochloride, polyethyleneimine, polyvinylpyridinium halide, melamine resin, polyurethane, carboxymethylcellulose, hydroxyethylcellulose, cationized hydroxyethylcellulose, hydroxypropylcellulose, polyesters, sodium polyacrylate, and the like; or mixtures of two or more of the above materials as desired. However, the ink-receiving layers comprising at least one of the the above-mentioned hydrophilic or water-soluble resins tend to cause "beading" and are liable not to give precise images when a large quantity of ink is applied.

Japanese Patent Application Laid-open No.57-173194 discloses a method for preventing the beading, in which a particulate water-absorbent resin is used additionally. Thereby, the beading is seemingly inhibited, while most portion of the ink is disadvantageously absorbed by the particulate water-absorbent resin according to detailed observation by optical microscopy, which results in low optical density of the image as a whole in the ink receiving layer.

The anti-blocking property is discussed below. Japanese Patent Application Laid-open No. 59-174382 discloses a recording medium containing a condensate of D-sorbitol with benzaldehyde, where the condensate is used in an amount of from 5 to 200 parts by weight based on 100 parts by weight of the polymer material constituting the ink-receiving layer.

The material used in the above Laid-open Publication is satisfactory in anti-blocking property of printed portions when the above condensate is used in an amount of not less than 70 parts by weight based on 100 parts by weight of the polymer material in the ink-receiving layer.

However, the water-soluble resin used for the recording medium is not compatible with the aforementioned condensate, which causes problems of whitening by separation of the condensate from the ink-receiving layer during long-term storage under the condition of high temperature and high humidity, or whitening found around a printed portion caused by alcohol or polyhydric alcohol suitably employed in water or aqueous ink.

Accordingly, the compatibility, particularly in long time, is important in systems which employ a water-soluble resin for raising ink absorbency and employ an additional water-insoluble compound for improving anti-blocking property.

Thus practically, the prior art technique cannot simultaneously achieve the ink absorbency, anti-blocking property, anti-beading property, and storage stability.

SUMMARY OF THE INVENTION

An object of the present invention is to provide a method for producing a recording medium which is superior in ink absorbency, anti-blocking property, and anti-beading property even at application of a large amount of ink in high density.

Another aspect of the present invention is to provide a method for producing a recording medium which has the above-mentioned recording characteristics invariably even after a long-term storage under high temperature conditions and is superior in light-transmissivity for use in OHP or the like.

Still another object of the present invention is to provide a method for producing a recording medium which is superior in storability of a printed matter in long-term storage under high temperature and high humidity conditions.

The above objects are achieved by the present invention shown below.

According to an aspect of the present invention, there is provided a method for producing a recording medium having a substrate and an ink-receiving layer formed on the substrate, comprising (a) dissolving a plurality of organic compounds in a first solvent which is a good solvent in common for all of the organic compounds to form a solution, applying the solution onto a substrate and evaporating the first solvent off to form an ink-receiving layer, and then (b) applying onto the ink-receiving layer a second solvent which is a poor solvent for at least one of the organic compounds and is a good solvent for the rest of the organic compounds and evaporating the second solvent off.

According to another aspect of the present invention, there is provided a method for producing a recording medium having a substrate and an ink-receiving layer formed on the substrate, comprising dissolving with heating a plurality of organic compounds in a solvent which is a poor solvent for at least one of the organic compounds and is a good solvent for the rest of the organic compounds to form a solution, applying the heated solution on a substrate and evaporating the solvent off to form an ink-receiving layer.

According to still another aspect of the present invention, there is provided a method for producing a recording medium having a substrate and an ink-receiving layer constituted of plural layers formed on the substrate, comprising (a) forming a lower ink-receiving layer on a substrate; (b) dissolving a plurality of organic compounds in a first solvent which is a good solvent in common for all of the organic compounds to form a solution, and applying the solution on the lower ink-receiving layer and evaporating the first solvent off to form an uppermost ink-receiving layer; and then (c) applying onto the uppermost ink-receiving layer a second solvent which is a poor solvent for at least one of the organic compounds and is a good solvent for the rest of the organic compounds and evaporating off the second solvent.

According to a further aspect of the present invention, there is provided a method for producing a recording medium having a substrate and an ink-receiving layer constituted of plural layers formed on the substrate, comprising (a) forming a lower ink-receiving layer on a substrate; and (b) dissolving with heating a plurality of organic compounds in a solvent which is a poor solvent for at least one of the organic compounds and is a good solvent for the rest of the organic compounds to form a solution, applying the heated solution onto the lower ink-receiving layer and evaporating the solvent off to form an uppermost ink-receiving layer.

DETAILED DESCRIPTION OF THE PREFERRED EMBODIMENT

The recording medium of the present invention comprises a substrate and an ink-receiving layer formed on the surface of the substrate.

The substrate may be made of either a light-transmissive material or a non-light-transmissive material. The light-transmissive substrate material includes films and plates of polyester resins, diacetate resins, triacetate resins, acrylic resins, polycarbonate resins, polyvinyl chloride resins, polyimide resins, and the like, as well as glass.

The ink-receiving layer formed on a surface of a substrate in the present invention contains a plurality of organic compounds. The organic compounds are preferably a combination of a water-soluble organic compound and a water-insoluble organic compound. The water-soluble organic compound, which absorbs aqueous ink, improves the anti-beading property, while the water-insoluble organic compound improves anti-blocking property.

The water-soluble organic compound in the present invention is defined to be an organic compound which have a solubility of not less than 10 g in 100 g of pure water at 25° C., and the water-insoluble organic compounds are those which has a solubility of less than 1 g under the same condition. The solubility can be determined by measuring the maximum gram amount of a solute soluble in 100 g of a solvent at 25° C.

The water-soluble organic compounds employed in the present invention include high-molecular compounds and low-molecular compounds. The low-molecular compounds in the present invention have preferably a molecular weight of less than 5,000, more preferably less than 2,000, but are not limited thereto. The high-molecular compounds have preferably a molecular weight of not less than 5,000, more preferably not less than 10,000. The molecular weight can be measured by GPC (gel permeation chromatography).

The water-soluble high-molecular organic compounds include natural resins such as albumin, gelatin, casein, starch, gum arabic, sodium elginate, and the like; and synthetic resins such as carboxymethylcellulose, hydroxyethylcellulose, hydroxypropylcellulose, polyacrylamide, polyethyleneimine, polyvinylpyrrolidone, poly(N-vinyl-3-methylpyrrolidone), polyvinylimidazole, polyvinyl alcohol, polyethylene oxide, sodium polyacrylate, polyamides, polyacrylamine, polyallylamine hydrochloride, polyvinylpyridinium halide, and the like.

The water-soluble low-molecular organic compounds include ethylene glycol, polyethylene glycol, propylene glycol, polypropylene glycol, poly(ethylene glycol-propylene glycol) copolymer, polyhydric alcohols such as D-sorbitol and sucrose, and the like.

The water-insoluble organic compounds include water-insoluble high-molecular compounds and water-insoluble low-molecular compounds.

The water-insoluble high-molecular compounds include acrylic resins such as polymethyl methacrylate, nylon resins such as 6,6-nylon, polystyrene resins, phenol resins, epoxy resins, vinyl chloride resins, polyester resins, polyurethane resins, and the like.

The water-insoluble low-molecular compounds include condensates of D-sorbitol with an aromatic aldehyde, 3,9-bis(1,1-dimethyl-2-hydroxyethyl)-2,4,8,10-tetraoxaspiro[5.5]undecane, 2,2-bis(4'-oxyphenyl)propane, the aforementioned diacetate compounds, and the like.

In the present invention, in addition to the above compounds, a resin which is soluble in usual organic solvent may be additionally used for adjusting the hydrophilicity of the ink-receiving layer. The examples to be preferably used are N-methoxymethylated nylon (type-8 nylon), polyvinylbutyral, polymethylmethacrylate, polystyrene, phenol resins, epoxy resins, polyvinyl chloride, polyesters, polyurethans, and the like. In the case where an acid dye or a direct dye is used in an aqueous ink, a cationic resin may be employed to prevent running or elution of the dye after recording. In this case, in particular, running of the dye in the recorded matter at a high temperature and a high humidity is suppressed. The examples of the high-molecular compounds for this purpose are cationic polyvinyl alcohol, cationic hydroxyethylcellulose, cationic-monomer-containing acryic resins, and the like.

The ink-receiving layer in the present invention is formed by employing the combination of the aforementioned organic compounds having different solubility in water. Preferable examples of the combination are combination of a water-soluble resin with a water-insoluble low-molecular compound, and combination of a water-insoluble resin with a water-soluble low-molecular compound. Thus in the present invention, a mixture system is preferable in which the ink absorbency and the anti-blocking property are respectively given by separate materials.

In the aforementioned combination of the organic compounds, the ratio of the water-soluble organic compound to the water-insoluble organic compound depends on the compounds to be combined. Generally the ratio is in the range of from 2:8 to 8:2, preferably from 3:7 to 7:3. Since higher molecular weight of the water-soluble organic compound is preferable from the standpoint of the anti-blocking property, combinations of a water-soluble resin with a water-insoluble low-molecular compound are still more preferable.

The systems employing a water-soluble low-molecular compound have a decreased anti-blocking property owing to elution of the low-molecular compound by attaching of water or aqueous ink on the ink-receiving layer.

The combination of a water-insoluble resin and a water-insoluble low-molecular compound reduces the ink absorbency owing to the absence of a material having affinity to aqueous ink although the combination gives superior anti-blocking property.

Accordingly, the combinations of a water-soluble resin and a water-insoluble low-molecular compound is the most desirable for the ink-receiving layer in the present invention. Among the water-soluble resins, polyvinylpyrrolidone is an excellent water soluble resin in view of the ink absorbency.

The useful water-insoluble low-molecular weight compounds for the present invention are mentioned above. Among them, condensates of sorbitol with an aromatic aldehyde is the most suitable one. The condensates are described below in detail.

As the sorbitol, D-sorbitol is convenient since the D type thereof is more readily available.

The aromatic aldehydes include benzaldehyde, halogenated benzaldehydes, tolualdehyde, salicylaldehyde, cinnamaldehyde, naphthoaldehyde, and the like. The condensates of these compound with sorbitol may be used singly or in combination.

Among them, the condensate of D-sorbitol with benzaldehyde is the most suitable one since it is readily available and exhibits a high gelation effect.

The condensate of D-sorbitol with benzaldehyde is synthesized by the condensation reaction of D-sorbitol with benzaldehyde. The molar ratio of the D-sorbitol to the benzaldehyde in the condensate can be 1:1, 1:2, or 1:3. The condensate of 1:2 or 1:3 is preferably used, but the condensate of 1:2 is the most suitable.

The condensate of D-sorbitol with benzaldehyde in a molar ratio of 1:2 is called dibenzylidene sorbitol (trade name: Gelol D, made by Shinnippon Rika K.K.), and the one in the molar ratio of 1:3 is called tribenzylidene sorbitol (trade name: Gelol T, made by Shinnippon Rika K.K.).

Dibenzylidene sorbitol is a chemically neutral compound having a certain solubility (15 g or so in 100 g of solvent) in solvents like N-methylpyrrolidone, N,N-dimethylformamide, dimethylsulfoxide, etc., but has low solubility in most of solvents such as water, ethyl alcohol, isopropyl alcohol, ethylene glycol, glycerin, diethylene glycol, benzyl alcohol, ethylcellosolve, tetrahydrofuran, dioxane, cyclohexylamine, aniline, pyridine, and the like.

The ink-receiving layer of the recording medium of the present invention may be formed on both the surfaces of the substrate, and may be a single layer or constituted of plural layers (multilayer). The multilayer one is constituted so as to have the construction of the above-mentioned ink-receiving layer at the outermost layer.

The material used for the lower layer has high mechanical strength even after absorption of aqueous ink, and is exemplified by polyvinyl alcohol, gum arabic, hydrophilic nylon, a hydrophilic polyurethane, a hydrophilic polyester, etc., among which polyvinyl alcohol is particularly preferable.

The saponification degree of the polyvinyl alcohol is suitably selected depending on the constituting material of the outermost layer, the solvent, and so forth, generally within the range of from 80% to 100% preferably from 85% to 100%. At a high saponification degree, polyvinyl alcohol copolymerized with a cationic monomer (e.g., a monomer containing a quaternary ammonium group) may be used, which gives sufficient mechanical strength after aqueous ink absorption. Further in relation with the mechanical strength, the polymerization degree of 300 or more is preferable. If the polymerization degree is less than 300, the mechanical strength. falls disadvantageously after aqueous ink absorption.

Further, the objects of the present invention are found to be achieved by the methods for producing the recording medium in addition to the above-mentioned constituting materials, the ratio thereof, and the layer constitution of the recording medium.

In one method of production, an ink receiving layer is applied once on a substrate by using a common good solvent and drying it, then applying onto the ink-receiving layer (or immersing the ink-receiving layer into) another solvent which is a poor solvent for at least one organic compound and is a good solvent for the rest of the organic compound and drying it.

In another method of production, two or more organic compounds are dissolved by heating at 50° C. to 170° C. in a solvent which is a poor solvent for at least one organic compound and is a good solvent for the rest of the organic compound, applying the resulting solution onto a substrate, and drying it.

The good solvent in the present invention is a solvent in which the intended organic compound exhibits a solubility of not less than 10 g per 100 g of solvent at 25° C., and the poor solvent is a solvent in which the solubility is less than 1 g per 100 g of solvent.

The first method of production is described below.

The aforementioned organic compounds having different water-solubility are dissolved in a desired ratio in a common good solvent. The resulting solution is applied on a substrate, and is dried to provide a base form of the ink-receiving layer of the present invention. The thickness of the ink-receiving layer is generally within the range of from 1 μm to 100 μm, preferably from 2 μm to 30 μm.

Subsequently, another solvent which is a poor solvent for at least one organic compound constituting the ink-receiving layer and is a good solvent for the other organic compounds is applied onto the ink-receiving layer, and the solvent is evaporated off. It has been found that this method can make it possible to keep two or more organic compounds having different compatibilities in an seemingly compatible state stably for a long time, in addition to the ink absorbency and the printing quality.

Any solvent which satisfies the above requirements may be employed in the present invention. However, the solvents having a boiling point of lower than 200° C. are preferable in view of the evaporation rate. Solvents having a boiling point of 200° C. or higher involves the problems that a high-temperature heat source is needed at the final drying step, and the materials for the ink-receiving layer and the substrate is limited because of the high-temperature drying.

The application solvent suitably employed in the present invention (hereinafter referred to as "solvents of group [A]") includes water; alcohols such as ethyl alcohol, isopropyl alcohol, n-propyl alcohol, butanol, etc.; aromatic solvents such as benzene, toluene, xylene, etc.; ketones such as acetone, methyl ethyl ketone, methyl isobutyl ketone, cyclohexanone, etc.; esters such as ethyl acetate, butyl acetate, etc.; and so forth. For the material for the ink receiving-layer of the present invention, preferable are combinations of a water-soluble resin with a water-insoluble low-molecular compound, or a water-insoluble resin with a water-soluble low-molecular compound. In this respect, the solvent which exhibits the most different dissolving power to the two or more materials is water. Water is also superior in the vapor pressure, the boiling point, and non-toxicity. To the water, a lower alcohol, etc. may be added to reduce the surface tension of water and to apply it uniformly onto the ink-receiving layer.

The solvent mainly constituted of water should preferably contain water at a content of not less than 50% by weight of the solvent. If the content is less than 50% by weight, the solubility or an appropriate evaporation rate of water cannot be attained, resulting in strict limitation of conditions for treating the ink-receiving layer. The application of the above solvent onto the ink-receiving layer is preferably in an amount of not less than 0.1 g/m$^2$ (approximately 0.1 μm in thickness).

The temperature for evaporating the solvent having applied onto the ink-receiving layer is preferably within the range of from 50° C. to 170° C. A higher temperature is more effective for changing the compatibility in the ink-receiving layer, although the temperature depends on the boiling point and the vapor pressure of the solvent. However, an extremely high temperature for drying the solvent may shorten the time for the compatibility change, resulting in insufficiency of the treatment.

With the suitable aqueous solvent containing water at a content of not less than 50% by weight, the drying need to be conducted at 50° C. or higher. If dried at a temperature lower than 50° C., the organic compounds having once undergone phase separation do not become compatible, sometimes resulting in decrease of transmissivity of the ink-receiving layer after the drying.

The ink-receiving layer is preferably formed by applying the coating liquid on a light-transmissive substrate by a known method such as roll coating, rod-bar coating, spray coating, and air-knife coating, and evaporating the solvent.

Thereafter, the second solvent is applied by a method such as rod-bar coating, spray coating, air-curtain coating, and dipping.

Next, the second method of production of the present invention is described below.

In this method, the plurality of organic compounds is dissolved in a solvent which is a poor solvent for at least one of the organic compounds constituting the ink-receiving layer and is a good solvent for the other organic compounds by heating up to a temperature of from 50° C. to 70° C. The solution is applied on a substrate, and the solvent is evaporated.

For this purpose, any heated solvent may be used which satisfies the above requirements. At least one of the solvents is preferably used (hereinafter referred to as "solvents of group [B]"), which include water, ethyl alcohol, propyl alcohol, butyl alcohol, 2-ethylhexanol, benzyl alcohol, ethylene glycol, diethylene glycol, methylcellosolve, ethylcellosolve, butylcellosolve, dioxane, morpholine, pyridine, cyclohexylamine, aniline, nitrobenzene, sulforane, tetrahydrofuran, formamide, methy ethyl ketone, dioctyl phthalate, and the like.

In either of the first method and the second method, the ink-receiving layer particularly preferably contains polyvinylpyrrolidone and a condensate of sorbitol with benzaldehyde.

The recording mediums formed as described above are light-transmissive recording mediums having sufficient light-transmissivity if a light-transmissive substrate material is used.

The sufficient light-transmissivity in the present invention means the haze of the recording medium of not more than 50%, preferably not more than 20%. If the haze is 50% or less, the recorded image can be projected onto a screen by OHP and the detail of the recorded image can be observed sharply.

The recording mediums of the above-described various embodiments in the present invention can further be improved, by applying a fine powdery organic or inorganic material in an amount of from about 0.01 to about 1.0 g/m$^2$, regarding the deliverability of the recording medium in a printer, anti-blocking property on stacking, resistance to fingerprint, and so forth.

The methods for producing a recording medium having an ink-receiving layer constituted of plural layers mentioned-above are described below. Such a recording medium can be prepared by two production methods.

In a first method, the plural components of the uppermost layer (two or more organic compounds) are dissolved in a good solvent. The resulting solution is applied onto the other layer(s) which is a lower ink-receiving layer having been previously formed on a substrate, thereby forming the uppermost layer. Subsequently, another solvent which is a poor solvent for at least one component of the uppermost layer but is a good solvent for the other component(s) is applied onto the uppermost layer, and then the solvent is evaporated off.

The good solvent herein is a solvent in which the intended organic compound exhibits a solubility of not less than 10 g at 25° C., and the poor solvent is a solvent in which the solubility is less than 1 g.

Any solvent which satisfy the above requirements may be employed in the present invention. However, solvents having a boiling point of lower than 200° C. are preferable in view of the evaporation rate. Solvents having a boiling point of 200° C. or higher involves the problems that a high-temperature heat source is needed at the final drying step, and the materials for the ink-receiving layer and the substrate are limited in heat resistance because of the high-temperature drying.

The application solvents suitably used in the method of the present invention include those mentioned above as the solvents of group [A]. As a component of the uppermost layer of the ink-receiving layer in the present invention, preferable are a combination of a water-soluble resin with a water-insoluble low-molecular compound, etc. In this respect, the solvent which exhibits the most different dissolving power to the two or more components is water. Water is also superior in the vapor pressure, the boiling point, and non-toxicity. To the water, a lower alcohol may be added to reduce the surface tension of water for uniform application onto the uppermost layer.

The solvent mainly constituted of water should preferably contain water at a content of not less than 50% by weight of the solvent. If the content is less then 50% by weight, the solubility or the appropriate evaporation rate of water cannot be attained, resulting in strict limitation of conditions for treating the ink-receiving layer with the solvent. The impregnation amount of the above solvent into the uppermost layer is preferably in an amount of not less than 0.1 g/m$^2$ (approximately 0.1 μm in thickness).

The temperature for evaporating the solvent impregnated into the uppermost layer is preferably within the range of from 50° C. to 170° C. A higher temperature is more effective for changing the compatibility of the uppermost layer, although it depends on the boiling point and the vapor pressure of the solvent. However, an extremely high temperature for evaporation of the solvent may shorten the time for the compatibility change, resulting in insufficiency of the treatment.

For a solvent containing not less than 50% by weight of water suitably used in the present invention, drying must be conducted at 50° C. or higher. If dried at a temperature lower than 50° C., the components constituting the uppermost layer having once undergone phase separation do not become compatible again, resulting in opacity of the ink-receiving layer after the drying.

The solvent may be suitably impregnated into the uppermost layer by rod-bar coating, spray coating, air-curtain coating, dipping, or the like.

In a second method, the constituting components for the uppermost layer are dissolved in a solvent which is a poor solvent for at least one component of the uppermost layer but is a good solvent for the other component(s) by heating up to a temperature of from 50° C. to 170° C. The resulting solution is applied onto the other layer(s) which is a lower ink-receiving layer having been previously formed on a substrate, and then the solvent is evaporated off.

The solvents suitably used in the method of the present invention include, for example, those mentioned above as the solvents of group [B].

In the above first and the second methods, the materials used for the uppermost layer may include those mentioned already. Among them, the uppermost layer containing polyvinylpyrrolidone and the condensate of sorbitol with a benzaldehyde are particularly preferable.

In the production methods described above, the ink absorbency of the uppermost layer is improved. The recording mediums thus produced have sufficient light-transmissivity.

The sufficient light-transmissivity in the present invention means the haze of the recording medium of not more than 50%, preferably not more than 20%. If the haze is 50% of less, the recorded image can be projected onto a screen by OHP and the detail of the recorded image can be observed sharply.

In the methods described above, the preferable thickness of the lower ink-receiving layer (other layer) depends on the material of the uppermost layer and the total thickness of the ink-receiving layer, but is generally in the range of from 1 μm to 50 μm, more preferably from 2 μm to 15 μm. If the other layer has a thickness of less than 1 μm, most of the ink absorbency and the anti-blocking property come from the uppermost layer only, without sufficient synergistic effect with the other layer in the ink receiving layer. If the other layer has a thickness of more than 50 μm, curling of the medium may occur although the ink absorbency, the anti-blocking property etc. are improved.

The lower ink-receiving layer need not be of a single layer, but may be of plural, laminated layers constituted of the aforementioned materials in different constitutional ratio. In this case, the total thickness of the lower layers is preferable in the range of from 1 μm to 50 μm.

On the other hand, the thickness of the uppermost layer (ink-absorbing layer) should be determined in consideration of the balance with the lower (other) layer, and is generally in the range of from 0.1 μm to 30 μm, preferably from 0.2 μm to 10 μm. If the thickness of the uppermost layer of the ink-receiving layer is less than 0.2 μm, the ink absorbency and the anti-blocking property are considerably low. If the thickness is more than 30 μm, curling of the medium occurs considerably even though the ink absorbency and the anti-blocking property is satisfactory.

The recording mediums of the above-described various embodiment in the present invention can further be improved, by applying a fine powdery organic or inorganic material in an amount of from about 0.01 to about 1.0 g/m$^2$, in the deliverability of the recording medium in a printer, anti-blocking property on stacking, resistance to fingerprint, and so forth.

The typical embodiments of the methods for producing the recording mediums of the present invention are described to explain the present invention. Naturally, the present invention is not limited to the embodiment. In any type of the embodiments, the ink-receiving layer may contain a variety of known additives such as a dispersant, a fluorescent dye, a pH controlling agent, an anti-foaming agent, a lubricating agent, an antiseptic agent, and the like.

The recording medium of the present invention need not always be colorless, but may be colored.

According to the production methods of the present invention described above, recording mediums are provided which are superior in ink absorbency, anti-blocking property, and anti-beading property, and give sharp recorded images with high resolution even at application of a large amount of ink at high density.

Further, recording mediums are provided which have the above-mentioned recording properties invariably even after a long-term storage under high temperature conditions, and are superior in light-transmissivity for use in OHP or the like.

Still further, recording mediums are provided which are superior in storability of printed matters in long-term storage under high temperature and high humidity conditions.

The present invention is described in more detail by referring to examples and comparative examples. In the description, the quantity represented by "parts" or "%" is based on weight unless otherwise mentioned.

EXAMPLE 1

A polyethylene terephthalate film of 100 μm thick (trade name: Lumirror T-100, made by Toray Industries, Inc.) was used as the substrate. Onto this film, the coating composition B-1 below was applied by a barcoater method to give a dried thickness of 12 μm, and was dried at 140° C. for 5 minutes.

Further onto the above ink-receiving layer, the solvent C-1 below was applied in an amount of 100 g/m$^2$, and left standing at room temperature for 20 seconds. Then the solvent C-1 was evaporated off at 140° C. for 5 minutes to prepare a recording medium D-1.

| Coating composition B-1 | |
|---|---|
| 1,3.2,4-dibenzylidene D-sorbitol (trade name: Gelol D, made by Shinippon Rika K.K.) | 40 parts |
| Polyvinylpyrrolidone (trade name: PVP K-90, made by G.A.F. Co.) | 50 parts |
| Cationic resin (trade name PQ-10, made by Soken Kagaku K.K.) | 10 parts |
| DMF | 500 parts |
| Solvent C-1 | |
| Isopropyl alcohol | 10 parts |
| Water | 90 parts |

EXAMPLE 2

A polyethylene terephthalate film of 100 μm thick (trade name: Lumirror T--100, made by Toray Industries, Inc.) was used as the substrate. Onto this film, the coating composition B-2 below was applied by a barcoater method to give a dried thickness of 15 μm, and was dried at 140° C. for 5 minutes.

Further onto the above ink-receiving layer, the solvent C-2 below was applied in an amount of 50 g/m$^2$, and left standing at room temperature for 30 seconds. Then the solvent C-2 was evaporated off at 100° C. for 10 minutes to prepare a recording medium D-2.

| Coating composition B-2 | |
|---|---|
| Polyvinylpyrrolidone (trade name: PVP K-90, made by G.A.F. Co.) | 50 parts |
| 1,3.2,4-dibenzylidene D-sorbitol (trade name: Gelol D, made by Shinippon Rika K.K.) | 50 parts |
| DMF | 500 parts |
| Solvent C-2 | |
| Water | 100 parts |

EXAMPLE 3

A polyethylene terephthalate film of 100 μm thick (trade name: Lumirror T-100, made by Toray Industries, Inc.) was used as the substrate. Onto this film, the coating composition B-3 below was applied by a barcoater method to give a dried thickness of 10 μm, and was dried at 100° C. for 10 minutes.

Further onto the above ink-receiving layer, the solvent C-3 below was applied in an amount of 60 g/m$^2$, and left standing at room temperature for 10 seconds. Then the solvent C-3 was evaporated off at 120° C. for 5 minutes to prepare a recording medium D-3.

| Coating composition B-3 | |
|---|---|
| Polyvinylpyrrolidone (trade name: PVP K-90, made by G.A.F. Co.) | 70 parts |
| 3,9-bis(1,1-dimethyl-2-hydroxyethyl)-2,4,8,10-tetraoxaspiro[5.5]undecane (trade name Spiroglycol, made by Mitsubishi Gas Chemical Co., Inc.) | 30 parts |
| DMF | 500 parts |
| Solvent C-3 | |
| 1-propanol | 10 parts |
| Water | 90 parts |

EXAMPLE 4

A polyethylene terephthalate film of 100 μm thick (trade name: Lumirror T-100, made by Toray Industries, Inc.) was used as the substrate. Onto this film, the coating composition B-4 below was applied by a barcoster methbd so as to give a dried thickness of 10 82 m, and was dried at 140° C. for 5 minutes.

Further onto the above ink-receiving layer, the solvent C-4 below was applied in an amount of 40 g/m$^2$. and was evaporated off at 70° C. for 30 minutes to prepare a recording medium D-4.

| Coating composition B-4 | |
|---|---|
| Polyvinylpyrrolidone (trade name: PVP K-90, made by G.A.F. Co.) | 70 parts |
| Bisphenol A | 30 parts |
| DMF | 500 parts |
| Solvent C-4 | |
| Water | 100 parts |

EXAMPLE 5

A polyethylene terephthalate film of 100 μm thick (trade name: Lumirror T-100, made by Toray Industries, Inc.) was used as the substrate. Onto this film, the coating composition B-5 below was applied by a barcoster method to give a dried thickness of 10 μm, and was dried at 140° C. for 5 minutes.

Further onto the above ink-receiving layer, the solvent C-5 below was applied in an amount of 50 g/m$^2$, and left standing at room temperature for 20 seconds. Then the solvent C-5 was evaporated off at 100° C. for 10 minutes to prepare a recording medium D-5.

| Coating composition B-5 | |
|---|---|
| Polyvinylpyrrolidone (trade name: PVP K-90, made by G.A.F. Co.) | 30 parts |
| Cationic resin (trade name: PQ-10, made by Soken Kagaku K.K.) | 10 parts |
| 1,3.2,4-dibenzylidene D-sorbitol (trade name: Gelol D, made by Shinippon Rika K.K.) | 60 parts |
| DMF | 400 parts |
| Solvent C-5 | |
| Ethyl alcohol | 60 parts |
| Water | 40 parts |

EXAMPLE 6

A polyethylene terephthalate film of 100 μm thick (trade name: Lumirror T-100, made by Toray Industries, Inc.) was used as the substrate. Onto this film, the coating composition B-6 below was applied by a bar-coater method to give a dried thickness of 12 μm, and was dried at 140° C. for 5 minutes.

Further onto the above ink-receiving layer, the solvent C-6 below was applied in an amount of 30 g/m$^2$ and left standing at room temperature for 20 seconds. Then the solvent C-6 was evaporated off at 140° C. for 5 minutes to prepare a recording medium D-6.

| Coating composition B-6 | |
|---|---|
| Polyvinylpyrrolidone (trade name: PVP K-90, made by G.A.F. Co.) | 90 parts |
| Polyvinylbutyral (trade name: S-LEC BH-S, made by Sekisui Chemical Co., Ltd.) | 10 parts |
| DMF | 600 parts |
| Solvent C-6 | |
| Water | 100 parts |

EXAMPLE 7

A polyethylene terephthalate film of 100 μm thick (trade name: Lumirror T-100, made by Toray Industries, Inc.) was used as the substrate. Onto this film, the coating composition B-7 below was applied by a bar-coater method to give a dried thickness of 10 μm, and was dried at 140° C. for 5 minutes.

Further onto the above ink-receiving layer, the solvent C-7 below was applied in a thickness of 50 μm, and left standing at room temperature for 20 seconds. Then the solvent C-7 was evaporated off at 100° C. for 10 minutes to prepare a recording medium D-7.

| Coating composition B-7 | |
|---|---|
| Polyvinylpyrrolidone (a water-soluble resin, the same one as mentioned above) | 40 parts |
| 1,3.2,4-dibenzylidene D-sorbitol (a water-insoluble low molecular compound, the same one as mentioned above) | 60 parts |
| DMF | 400 parts |
| Solvent C-7 | |
| Ethyl alcohol | 60 parts |
| Water | 40 parts |

EXAMPLE 8

A polyethylene terephthalate film of 100 μm thick (the same one as mentioned above) was used as the substrate. Onto this film, the coating composition B-8 below was applied by a bar-coater method to give a dried thickness of 12 μm, and was dried at 140° C. for 5 minutes.

Further onto the above ink-receiving layer, the solvent C-8 below was applied in a thickness of 30 μm, and left standing at room temperature for 20 seconds. Then the solvent C-8 was evaporated off at 140° C. for 5 minutes to prepare a recording medium D-8.

| Coating composition B-8 | |
|---|---|
| Hydroxypropylcellulose (a water-soluble resin made by Nippon Soda Co., Ltd.) | 70 parts |
| Bisphenol A (a water-insoluble low-molecular compound, same as the one mentioned above) | 30 parts |
| DMF | 500 parts |
| Solvent C-8 | |
| Water | 95 parts |
| Isopropyl alcohol | 5 parts |

EXAMPLE 9

A polyethylene terephthalate film of 100 μm thick (the same one as mentioned above) was used as the substrate. Onto this film, the coating composition B-9 below heated to 85° C. was applied by a bar-coater method to give a dried thickness of 12 μm, and was dried at 140° C. for 5 minutes to prepare a recording medium D-9.

| Coating composition B-9 | |
|---|---|
| 1,3.2,4-dibenzylidene D-sorbitol | 40 parts |
| Polyvinylpyrrolidone (a water-soluble resin, trade name: PVP K-90, made by G.A.F. Co.) | 50 parts |
| Cationic resin (a water soluble resin, trade name: PQ-10, made by Soken Kagaku K.K.) | 10 parts |
| Methylcellosolve | 1500 parts |

EXAMPLE 10

In the coating composition B-4 in Example 4, the 500 parts of DMF was replaced by 2000 parts of water and the liquid temperature was made 95° C. by heating. This composition was applied by a bar-coater method to give a dried thickness of 12 μm and dried at 140° C. for 5 minutes to prepare the recording medium D-10.

EXAMPLE 11

To the back surface of the recording medium D-1 obtained in Example 1, the same procedure was conducted to prepare the recording medium D-11 of both sides coating.

EXAMPLE 12

To the back surface of the recording medium D-9 obtained in Example 9, the same procedure was conducted to prepare the recording medium D-12 of both sides coating.

COMPARATIVE EXAMPLE 1

100 parts of polyvinyl alcohol (a water-soluble resin, PVA-217 made by Kuraray Co., Ltd., polymerization degree: 1700, saponification degree: 88%, solubility in pure water: not less than 10 g) was dissolved in 900 parts of water. The resulting solution was applied onto the same substrate as used in Examples by a bar-coater method to give a dried thickness of 12 μm, after drying at 140° C. for 5 minutes, thus a recording medium D-31 being prepared.

COMPARATIVE EXAMPLE 2

100 parts of polyvinylbutyral (a water-insoluble resin, trade name S-LEC BH-3, made by Sekisui Chemical Co.,Ltd., solubility in pure water: less than 1 g) was dissolved in 900 parts of ethylcellosolve. The resulting solution was applied onto the same substrate as used in Examples by a bar coater method to give a thickness of 12 μm after drying at 140° C. for 5 minutes, thus a recording medium D-32 being prepared.

COMPARATIVE EXAMPLE 3

A polyethylene terephthalate film of 100 μm thick (the same one as mentioned above) was used as the substrate. Onto this film, the coating composition B-33 below was applied by a bar-coater method to give a dried thickness of 12 μm after drying at 140° C. for 5 minutes to prepare a recording medium D-33.

| | |
|---|---|
| Coating composition B-33 | |
| 1,3.2,4-dibenzylidene D-sorbitol (a water-insoluble low molecular compound, the same one as mentioned above) | 40 parts |
| Polyvinylpyrrolidone (a water-soluble resin, trade name: PVP K-90, made by G.A.F. Co.) | 50 parts |
| Cationic resin (a water soluble resin, made by Soken Kagaku K.K., trade name: PQ-10) | 10 parts |
| DMF | 500 parts |

COMPARATIVE EXAMPLE 4

Onto the ink-receiving layer of the recording medium (comparative product) prepared in Comparative example 3, 100 parts of DMF was applied in a thickness of 100 μm. The coated article was left standing at room temperature for 20 seconds, and then dried at 140° C. for 5 minutes to prepare a recording medium D-34.

COMPARATIVE EXAMPLE 5

A recording medium D-35 was prepared in the same manner as in Example 9 except that the coating composition B-9 was applied at 25° C. without heating to 85° C.

EXAMPLE 13

A polyethylene terephthalate film of 100 μm thick (trade name: Lumirror T-100, made by Toray Industries, Inc.) was used as the substrate. Onto the both sides of this film, the coating composition A-13 below was applied by a bar-coater method to give a dried thickness of 6 μm, and was dried at 140° C. for 20 minutes, thus lower ink-receiving layers (other layers) being formed. Further onto the both surfaces of the above lower ink-receiving layers, the coating composition B-13 below was applied and dried at 110° C. for 5 minutes to give a thickness of 5 μm to form ink-receiving surface layers (uppermost layers). Then the solvent C-13 below was applied onto the both of the uppermost ink-receiving layers in an amount of 50 g/m$^2$, and left standing for 20 seconds at room temperature. Then the solvent C-13 was evaporated off at 70° C. for 5 minutes to prepare a recording medium D-13.

| | |
|---|---|
| Coating composition A-13 (for the other layer) | |
| Polyvinyl alcohol (completely saponified product, trade name: Poval 110, made by Kuraray Co., Ltd., polymerization degree 1100) | 10 parts |

-continued

| | |
|---|---|
| Pure water | 90 parts |
| Coating composition B-13 (for the uppermost layer) | |
| Polyvinylpyrrolidone (a water-soluble resin, trade name: PVP K-90, made by G.A.F. Co.) | 60 parts |
| 1,3.2,4-dibenzylidene D-sorbitol (a water-insoluble low-molecular compound, trade name: Gelol D, made by Shinippon Rika K.K.) | 40 parts |
| DMF | 400 parts |
| Solvent C-13 | |
| Isopropyl alcohol | 10 parts |
| Water | 90 parts |

EXAMPLE 14

A recording medium D-14 is prepared in the same manner as in Example 13 except that the coating composition A-14 is used in place of A-13, the coating composition B-14 is used in place of B-13, and the solvent C-14 is used in place of C-13. Example 15 and the followings are conducted similarly.

| | |
|---|---|
| Coating composition A-14 (for the other layer) | |
| Cationated polyvinyl alcohol (completely saponified product, trade name: Cation polymer C118.AA, made by Kuraray Co., Ltd. polymerization degree: 1800, cationation: 8% | 10 parts |
| Pure water | 90 parts |
| Coating composition B-14 (for the uppermost layer) | |
| Polyvinylpyrrolidone (the same as the one mentioned above) | 50 parts |
| 1,3.2,4-dibenzylidene D-sorbitol (the same as the one mentioned above | 50 parts |
| DMF | 400 parts |
| Solvent C-14 | |
| Pure water | 40 parts |
| Ethyl alcohol | 60 parts |

EXAMPLE 15

A recording medium D-15 was prepared in the same manner as in Example 14 except that the solvent C-15 below was used in place of the solvent C-14.

| | |
|---|---|
| Solvent C-15 | |
| Methylcellosolve | 100 parts |

EXAMPLE 16

A recording medium D-16 was prepared in the same manner as in Example 13 except that the coating composition B-16 was used in place of B-13.

| | |
|---|---|
| Coating composition B-16 (for the uppermost layer) | |
| Hydroxypropylcellulose (a water-soluble resin, trade name HPL-SC, made by Nippon Soda Co.) | 70 parts |
| 1,3.2,4-dibenzylidene D-sorbitol (the same one as mentioned above | 30 parts |
| DMF | 400 parts |

EXAMPLE 17

A recording medium D-17 was prepared in the same manner as in Example 13 except that the coating composition B-17 was used in place of B-13.

| Coating composition B-17 (for the uppermost layer) | |
|---|---|
| Polyvinylpyrrolidone (the same one as mentioned above) | 70 parts |
| 3,9-bis(1,1-dimethyl-2-hydroxyethyl)-2,4,8,10-tetraoxaspiro[5.5]undecane (a water-insoluble low-molecular compound, trade name: Spiroglycol, made by Mitsubishi Gas Chemical Co, Inc.) | 30 parts |
| DMF | 400 parts |

EXAMPLE 18

A recording medium D-18 was prepared in the same manner as in Example 13 except that the coating composition A-18 was used in plate of A-13.

| Coating composition A-18 | |
|---|---|
| N-methoxymethylated nylon (trade name: Toresin F30, made by Teikoku Kagaku Sangyo K.K., methoxymethylation degree: ca. 30%) | 20 parts |
| Water | 24 parts |
| Methanol | 56 parts |

EXAMPLE 19

The coating composition A-13 was applied on the substrate in the same manner as in Example 13. Onto the both surfaces of the lower ink-receiving layer, the coating composition B-19 below kept heated at 85° C. was applied by a bar-coater method to give a dried thickness of 5 μm, and dried at 110° C. for 3 minutes to give a recording medium D-19.

| Coating composition B-19 | |
|---|---|
| Polyvinylpyrrolidone (aforementioned) | 60 parts |
| 1,3.2,4-dibenzylidiene D-sorbitol | 40 parts |
| Methylcellosolve | 1300 parts |

EXAMPLE 20

A recording medium D-20 of single side coating was prepared as in the same manner as Example 13.

EXAMPLE 21

A recording medium D-21 of single side coating was prepared as in the same manner as Example 19.

COMPARATIVE EXAMPLE 6

A recording medium D-22 was prepared in the same manner as in Example 13 except that only the coating composition A-13 was applied on the both sides of a 100μm-thick polyethylene terephthalate film.

Characteristic values of the above-used materials are shown in Table 1.

Ink jet recording was conducted on the recording mediums prepared in the above Examples and Comparative examples with four kinds of inks below by use of an recording apparatus having bubble jet recording heads for ejecting ink by bubbling of ink (volume of an ejected droplet: 24 pl, head density: 16 pel/mm, maximum ejection of single color: 6 nl/mm$^2$, maximum superposition of color: 3 colors, and ejection frequency: 4 kHz).

| Yellow ink (composition) | |
|---|---|
| C.I. Acid Yellow 23 | 3% by weight |
| Diethylene glycol | 15% by weight |
| Water | 82% by weight |
| Cyan ink (composition) | |
| C.I. Direct Blue 86 | 3% by weight |
| Diethylene glycol | 15% by weight |
| Water | 82% by weight |
| Magenta ink (composition) | |
| C.I. Acid Red 35 | 3% by weight |
| Diethylene glycol | 15% by weight |
| Water | 82% by weight |
| Black ink (compositon) | |
| C.I. Direct Black 19 | 3% by weight |
| Diethylene glycol | 15% by weight |
| Water | 82% by weight |

The results are shown in Table 2 and Table 3.

The respective evaluation items in Table 2 was measured according to the methods below.

(1) The haze was measured by use of a direct-reading haze meter (made by Toyo Seiki Seisakusho) having an optical system in accordance with JIS K 6714.

(2) The ink absorbency was evaluated by touching the recorded image with a finger after the recording medium having recorded 3-color full dots (yellow, cyan, and magenta) was exposed to hot air (100° C., air velocity of 1 m/sec, 10 seconds) according to whether the ink does not transfer to the finger as the result of penetration of ink into the interior of the ink receiving layer. The symbol "o" denotes no transfer of ink to the finger, "x" denotes transfer of ink, and "Δ" denotes an intermediate state.

(3) The anti-beading property was evaluated visually after the recording of 3-color full dots of yellow, cyan, and magenta was conducted. The symbol "o" denotes no occurrence of beading, "x" denotes occurrence of beading, and "Δ" denotes an intermediate state.

(4) The anti-blocking property was evaluated, after the recording medium having received a three-color full dot image (yellow, cyan, and magenta) was exposed to hot air (100° C., air velocity of 1 m/sec, 10 seconds), by laminating a polyethylene terephthalate film on the recorded image at a pressure of 40 g/cm$^2$ and then peeling the film from the recording medium. The symbol "o" shows that the film is readily peelable. The symbol "x" shows that the film is peelable with a considerable force. The symbol "Δ" shows the intermediate state.

(5) The haze of the film after high-temperature high-humidity storage was measured of the film after kept standing at 35° C. and 90 %RH for 10 hours by means of the haze meter employed in the item (1) above.

(6) The light-transmissivity of the printed matter after high-temperature high-humidity storage was measured after the medium having a recorded three-color full dot image of yellow, cyan, and magenta and kept standing at 35° C. and 90 %RH for 100 hours. The symbol "o" shows that no whitening is observed around the printed portion. The symbol "Δ" shows that whitening occurs but is not observed on OHP projection. The symbol "x" shows that whitening occurs and the whitened portion is projected as black by OHP.

(7) The haze of the film after high-temperature storage was measured by the procedure employed in the item (1) above, after the recording medium was sealed in an aluminum-laminated polyethylene bag and stored at 60° C. and 90 %RH for 200 hours.

The respective evaluation items in Table 3 was measured according to the procedures below.

(1) The ink absorbency was evaluated by observing the occurrence of the disturbance in a three-color full dot image of yellow, cyan, and magenta having been recorded and left standing for 3 minutes at 25° C. and 50 %RH, when rubbed with silbon paper (lens cleaner paper) at a pressure of 10 g/cm$^2$. The symbol "○" shows that neither disturbance nor transfer of ink is observed. The symbol "Δ" shows that slight disturbance of image or slight transfer of ink is observed. The symbol "x" shows that remarkable disturbance of image or remarkable ink transfer occurs.

(2) The haze was measured by use of a direct-reading haze meter (made by Toyo Seiki Seisakusho).

(3) The anti-beading property was evaluated visually after the recording of 3-color full dots of yellow, cyan, and magenta was conducted. The symbol "○" denotes no occurrence of beading, "x" denotes occurrence of beading, and "Δ" denotes an intermediate state.

(4) The anti-blocking property was evaluated, after the recording medium having received a three-color full dot image (yellow, cyan, and magenta) was left standing at 25° C. and 50 %RH for 24 hours, by laminating a polyethylene terephthalate film on the recorded image at a pressure of 40 g/cm$^2$ and then peeling the film from the recording medium. The symbol "○" shows that the film is readily peelable. The symbol "x" shows that the film is peelable with a considerable force. The symbol "Δ" shows the intermediate state.

(5) The curling degree was measured, after the medium having a recorded three-color full dot image of yellow, cyan, and magenta was kept standing at 25° C. and 50 %RH for 24 hours, by placing the medium on a reflection type OHP (Type 007, made by 3M Co.) for 5 minutes and observing whether the projected image is faded or doubled-visioned. One resulting in correct image is marked ○, faded or doubled-visioned image x, and intermediate Δ.

(6) The storability of image under high-temperature and high-humidity conditions was evaluated visually, after the medium having a recorded three-color full dot image of yellow, cyan, and magenta and kept standing at 25° C. and 50 %RH for 24 hours and further at 35° C. and 90 %RH for 24 hours. The symbol "○" denotes non-occurrence of running or whitening of the image. The symbol "x" denotes occurrence of running or whitening of the image. The symbol "Δ" denotes an intermediate state.

TABLE 1

| | | | Tradename | | | | | |
|---|---|---|---|---|---|---|---|---|
| | | | PVP k-90 | HPC-SL | Gelol D | Spiroglycol M.W. | Bisphenol | S-LEC BH-S |
| Solvent | | Dissol. Temp. | 360,000 | 30,000–50,000 | 358 | 304 | 228 | >100,000 |
| DMF | | 25° C. | ○ | ○ | ○ | ○$^{\Delta}$ | ○ | ○ |
| pure water | | 25° C. | ○ | ○ | X | X | X | X |
| pure water | | 95° C. | ○ | | X | | | |
| isopropyl alcohol | 10% | 25° C. | ○ | ○ | X | X | | |
| water | 90% | | | | | | | |
| n-propyl alcohol | 10% | 25° C. | ○ | | | X | | |
| water | 90% | | | | | | | |
| ethyl alcohol | 60% | 25° C. | ○ | | X | | | |
| water | 40% | | | | | | | |
| isopropyl alcohol | 5% | 25° C. | | ○ | | | X | |
| water | 95% | | | | | | | |
| methyl cellosolve | | 25° C. | ○ | | X | | | |
| methyl cellosolve | | 85° C. | ○ | | ○ | | | |

Solubility
○: >10 g
○$^{\Delta}$: ~10 g
Δ: 1~10 g
X: <1 g

TABLE 2

| | Example | | | | | | | | | | | | Comparative Ex. | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | | | | | |
| | Coating Composition | | | | | | | | | | | | | | | | |
| | B-1 | B-2 | B-3 | B-4 | B-5 | B-6 | B-7 | B-8 | B-9 | B-10 | B-11 | B-12 | | | | | |
| | Solvent | | | | | | | | | | | | | | | | |
| | C-1 | C-2 | C-3 | C-4 | C-5 | C-6 | C-7 | C-8 | none | none | C-1 | none | 1 | 2 | 3 | 4 | 5 |
| Haze | 3 | 3 | 3 | 4 | 3 | 3 | 3 | 3 | 4 | 4 | 5 | 6 | 3 | 3 | 3 | 3 | 35 |
| Ink absorbency | ○ | ○ | ○ | ○ | ○ | Δ | ○ | ○ | ○ | ○ | ○ | ○ | ○ | X | ○ | ○ | Δ |
| Anti-beading property | ○ | ○ | Δ | Δ | Δ | Δ | Δ | Δ | ○ | ○ | ○ | ○ | X | X | Δ | Δ | Δ |
| Anti-blocking property | ○ | ○ | ○ | ○ | ○ | ○ | ○ | ○ | ○ | ○ | ○ | ○ | X | ○ | ○ | ○ | Δ |
| Haze of film after high-temperature high-humidity storage | 3 | 3 | 3 | 6 | 5 | 3 | 5 | 3 | 4 | 4 | 5 | 6 | 4 | 3 | 61 | 63 | 40 |
| Light-transmissivity of printed matter after high-temperature high-humidity storage | ○ | ○ | ○ | ○ | Δ | ○ | Δ | ○ | ○ | ○ | ○ | ○ | ○ | ○ | X | X | X |

TABLE 2-continued

| | Example | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | | | | | |
| | Coating Composition | | | | | | | | | | | | | | | | |
| | B-1 | B-2 | B-3 | B-4 | B-5 | B-6 | B-7 | B-8 | B-9 | B-10 | B-11 | B-12 | | | | | |
| | Solvent | | | | | | | | | | | | Comparative Ex. | | | | |
| | C-1 | C-2 | C-3 | C-4 | C-5 | C-6 | C-7 | C-8 | none | none | C-1 | none | 1 | 2 | 3 | 4 | 5 |
| Haze of film after high-temperature storage | 3 | 3 | 3 | 5 | 4 | 3 | 4 | 3 | 4 | 4 | 5 | 6 | 3 | 3 | 25 | 24 | 35 |

TABLE 3

| | Lower layer | | | Uppermost layer | | | Solvent | | |
|---|---|---|---|---|---|---|---|---|---|
| Example | Composition | Drying temperature | Dried thickness | Composition | Drying temperature | Dried thickness | Composition | Applied amount | Drying temperature |
| 13 | A-13 | 140 | 6 | B-13 | 110 | 5 | C-13 | 50 | 70 |
| 14 | A-14 | 140 | 5 | B-14 | 110 | 4 | C-14 | 40 | 60 |
| 15 | A-14 | 140 | 5 | B-14 | 110 | 4 | C-15 | 60 | 80 |
| 16 | A-13 | 140 | 6 | B-16 | 110 | 4 | C-13 | 30 | 60 |
| 17 | A-13 | 140 | 6 | B-17 | 120 | 6 | C-13 | 30 | 60 |
| 18 | A-18 | 140 | 6 | B-13 | 110 | 5 | C-13 | 50 | 70 |
| 19 | A-13 | 140 | 6 | B-19 | 110 | 5 | — | — | — |
| 20 | A-13 | 140 | 6 | B-13 | 110 | 5 | C-13 | 50 | 70 |
| 21 | A-13 | 140 | 6 | B-19 | 110 | 5 | — | — | 70 |
| Comp. Ex. 6 | — | — | — | A-1 | 140 | 10 | — | — | — |

| | Ink absorbency | | | | | | | |
|---|---|---|---|---|---|---|---|---|
| Example | Lower layer only | Upper layer only | Overall | Haze | Anti-beading proerty | Anti-blocking proerty | Degree of curling | Image storability |
| 13 | X | Δ | ○ | 4 | ○ | ○ | ○ | ○ |
| 14 | X | Δ | ○ | 7 | ○ | ○ | ○ | ○ |
| 15 | X | Δ | ○ | 5 | ○ | ○ | ○ | ○ |
| 16 | X | Δ | ○ | 4 | ○ | ○Δ | ○ | ○ |
| 17 | X | Δ | ○ | 5 | Δ | ○ | ○ | ○ |
| 18 | X | Δ | ○Δ | 5 | ○ | ○ | ○Δ | ○ |
| 19 | X | Δ | ○ | 4 | ○ | ○ | ○ | ○ |
| 20 | X | Δ | ○ | 3 | ○ | ○ | X | ○ |
| 21 | X | Δ | ○ | 3 | ○ | ○ | X | ○ |
| Comp. Ex. 6 | — | — | X | 4 | X | X | ○ | Δ |

What is claimed is:

1. A method for producing a recording medium having (1) a substrate and (2) an ink-receiving layer comprising a water-soluble high molecular organic compound having a molecular weight of not less than 5,000, and a water-insoluble low-molecular organic compound having a molecular weight of less than 5,000 and being formed on the substrate, wherein said method comprises the steps of (a) dissolving a plurality of organic compounds comprising a water-soluble high molecular organic compound having a molecular weight of not less than 5,000 and which has a solubility of not less than 10 g in 100 g of pure water at 25° C., and a water-insoluble low-molecular organic compound having a molecular weight of less than 5,000 and which has a solubility of less than 1 g in 100 g of pure water at 25° C. in a first solvent which is a good solvent in common for all of the organic compounds to form a solution, applying the solution onto a substrate and evaporating the first solvent off to form an ink-receiving layer, and then (b) applying onto the ink-receiving layer a second solvent which is a poor solvent for at least one of the organic compounds and is a good solvent for the rest of the organic compounds and evaporating the second solvent off.

2. The method of claim 1, wherein said water-soluble high-molecular organic compound is at least one selected from the group consisting of albumin, gelatin, casein, starch, gum arabic, sodium alginate, carboxymethylcellulose, hydroxyethylcellulose, hydroxypropylcellulose, polyacrylamide, polyethyleneimine, polyvinylpyrrolidone, poly(N-vinyl-3-methylpyrrolidone), polyvinylimidazole, polyvinyl alcohol, polyethylene oxide, sodium polyacrylate, polyamide, polyacrylamine, polyallylamine hydrochloride, and polyvinylpyridinium halide.

3. The method of claim 1, wherein the ratio of said water-soluble organic compound and said water-insoluble organic compound is within the range of from 2:8 to 8:2.

4. The method of claim 1, wherein said water-insoluble low-molecular organic compound is at least one selected from the group consisting of condensates of D-sorbitol with an aromatic aldehyde, 3,9-bis(1,1-dimethyl-2-hydroxyethyl)-2,4,8,10-tetraoxaspiro[5,-5]undecane, 2,2-bis(4'-oxyphenyl)propane, and diacetate.

5. The method of claim 1, wherein said water-soluble organic compound is polyvinylpyrrolidone and said water-insoluble organic compound is a condensate of sorbitol with an aromatic aidehyde.

6. The method of claim 1, wherein said second solvent applied onto the ink-receiving layer contains from 50 to 100 % by weight of water.

7. The method of claim 1, wherein said recording medium is light-transmissive.

8. The method of claim 1, wherein said ink-receiving layer is formed on both the surfaces of the substrate.

9. A method for producing a recording medium having (1) a substrate and ink-receiving layer comprising a water-soluble high molecular organic compound having a molecular weight of not less than 5,000, and a water-insoluble low-molecular organic compound having a molecular weight of less than 5,000 and being formed on the substrate, said method comprising the steps of (a) dissolving with heating a plurality of organic compounds comprising a water-soluble high molecular organic compound having a molecular weight of not less than 5,000 and which has a solublity of not less than 10 g in 100 g of pure water at 25° C., and a water-insoluble low-molecular organic compound having a molecular weight of less than 5,000 and which has a solublity of less than 1 g in 100 g of pure water at 25° C. in a solvent which is a poor solvent for at least one of the organic compounds and is a good solvent for the rest of the organic compounds to form a solution, and (b) applying the heated solution on a substrate and evaporating the solvent off to form an ink-receiving layer.

10. The method of claim 9, wherein the ratio of said water-soluble organic compound and said water-insoluble organic compound is within the range of from 2:8 to 8:2.

11. The method of claim 9, wherein said water-soluble organic compound is polyvinylpyrrolidone and said water-insoluble organic compound is a condensate of sorbitol with an aromatic aldehyde.

12. The method of claim 9, wherein the temperature of said heated solution is within the range of from 50° C. to 170° C.

13. The method of claim 9, wherein said recording medium is light-transmissive.

14. The method of claim 9, wherein said ink-receiving layer is formed on both the surfaces of the substrate.

15. A method for producing a recording medium having (1) a substrate and (2) an ink-receiving layer constituted of plural layers formed on the substrate, the uppermost layer of said ink-receiving layer comprising a water-soluble high molecular organic compound having a molecular weight of not less than 5,000, and a water-insoluble low-molecular organic compound having a molecular weight of less than 5,000, said method comprising the steps of (a) forming a lower ink-receiving layer on a substrate; (b) dissolving a plurality of organic compounds comprising a water-soluble high molecular organic compound having a molecular weight of not less than 5,000, which has a solubility of not less than 10 g in 100 g of pure water at 25° C., and a water-insoluble low-molecular organic compound having a molecular weigh of less than 5,000 and which has a solubility of less than 1 g in 100 g of pure water at 25° C. in a first solvent which is a good solvent in common for all of the organic compounds to form a solution, applying the solution on the lower ink-receiving layer and evaporating the first solvent off to form an uppermost ink-receiving layer; and then (c) applying onto the uppermost ink-receiving layer a second solvent which is a poor solvent for at least one of the organic compounds and is a good solvent for the rest of the organic compounds and evaporating off the second solvent.

16. The method of claim 15, wherein the ratio of said water-soluble organic compound and said water-insoluble organic compound is within the range of from 2:8 to 8:2.

17. The method of claim 15, wherein said water-soluble organic compound is polyvinylpyrrolidone and said water-insoluble organic compound is a condensate of sorbitol with an aromatic aidehyde.

18. The method of claim 15, wherein said lower ink-receiving layer contains polyvinyl alcohol.

19. The method of claim 15, wherein said second solvent applied onto the ink receiving layer contains from 50 to 100% by weight of water.

20. The method of claim 15, wherein said recording medium is light-transmissive.

21. The method of claim 15, wherein said ink-receiving layer is formed on both the surfaces of the substrate.

22. A method for producing a recording medium having (1) a substrate and (2) an ink-receiving layer constituted of plural layers formed on the substrate, the uppermost layer of said ink-receiving layer comprising a water-soluble high molecular organic compound having a molecular weight of not less than 5,000, and a water-insoluble low-molecular organic compound having a molecular weight of less than 5,000, said method comprising (a) forming a lower ink-receiving layer on a substrate; and (b) dissolving with heating a plurality of organic compounds comprising a water-soluble high molecular organic compound having a molecular weight of not less than 5,000, and which has a solubility of not less than 10 g in 100 g of pure water at 25° C., and a water-insoluble low-molecular organic compound having a molecular weight of less than 5,000 and which has a solubility of less than 1 g in 100 g of pure water at 25° C. in a solvent which is a poor solvent for at least one of the organic compounds and is a good solvent for the rest of the organic compounds to form a solution, applying the heated solution onto the lower ink-receiving layer and evaporating the solvent off to form an uppermost ink-receiving layer.

23. The method of claim 22, wherein the ratio of said water-soluble organic compound and said water-insoluble organic compound is within the range of from 2:8 to 8:2.

24. The method of claim 22, wherein said water-soluble organic compound is polyvinylpyrrolidone and said water-insoluble organic compound is a condensate of sorbitol with an aromatic aldehyde.

25. The method of claim 22, wherein said lower ink-receiving layer contains polyvinyl alcohol.

26. The method of claim 22, wherein the temperature of said heated solution is within the range of from 50° C. to 170° C.

27. The method of claim 22, wherein said recording medium is light-transmissive.

28. The method of claim 22, wherein said ink-receiving layer is formed on both the surfaces of the substrate.

* * * * *

UNITED STATES PATENT AND TRADEMARK OFFICE

CERTIFICATE OF CORRECTION

PATENT NO. : 5,314,713

DATED : May 24, 1994

INVENTOR(S) : TAKAHIRO MORI, ET AL.

It is certified that error appears in the above-identified patent and that said Letters Patent is hereby corrected as shown below:

COLUMN 1

Line 51, "plurality" should read --a plurality--.
Line 61, "dissolved" should read --dissolves--.
Line 66, "investigation" should read --investigations--.

COLUMN 4

Line 25, "have" should read --has--.
Line 27, "has" should read --have--.
Line 43, "elginate," should read --alginate,--.

COLUMN 5

Line 19, "acryic" should read --acrylic--.
Line 67, "compound" should read --compounds--.

COLUMN 6

Line 41, "100%" should read --100%,--.
Line 50, "strength." should read --strength--.

COLUMN 7

Line 1, "compound," should read --compounds,--.
Line 24, "an" should read --a--.
Line 31, "involves" should read --involve--.
Line 34, "is" should read --are--.
Line 64, "having" should read --having been--.

UNITED STATES PATENT AND TRADEMARK OFFICE

CERTIFICATE OF CORRECTION

PATENT NO. : 5,314,713

DATED : May 24, 1994

INVENTOR(S) : TAKAHIRO MORI, ET AL.

It is certified that error appears in the above-identified patent and that said Letters Patent is hereby corrected as shown below:

COLUMN 8

Line 8, "need" should read --needs--.

COLUMN 9

Line 13, "solvent" should read --solvents--.
Line 17, "involves" should read --involve--.

COLUMN 10

Line 53, "is" should read --are--.

COLUMN 12

Line 40 , "coster methbd" should read --coater method-- and "10 82 m," should read --10 μm.--.
Line 42, "40 g/m$^2$." should read --40 g/m$^2$,--.
Line 61, "coster" should read --coater--.

COLUMN 13

Line 22, "30 g/m$^2$" should read --30 g/m$^2$,--.

COLUMN 14

Line 42, "12 μm" should read --12 μm,--.

UNITED STATES PATENT AND TRADEMARK OFFICE

CERTIFICATE OF CORRECTION

PATENT NO. : 5,314,713

DATED : May 24, 1994

INVENTOR(S) : TAKAHIRO MORI, ET AL.

It is certified that error appears in the above-identified patent and that said Letters Patent is hereby corrected as shown below:

COLUMN 15

Line 53, "the both" should read --both--.

COLUMN 16

Line 20, "the" should read --the Examples--.
Line 21, "lowings" should read --lowing--.

COLUMN 17

Line 17, "plate" should read --place--.
Line 55, "the both" should read --both--.
Line 62, "an" should read --a--.

COLUMN 22

Line 57, "tate." should read --tates.--.
Line 61, "aidehyde." should read --aldehyde.--.

COLUMN 23

Line 2, "and" should read --and (2) an--.
Line 11, "solublity" should read --solubility--.
Line 14, "solublity" should read --solubility--.
Line 51, "weigh" should read --weight--.

UNITED STATES PATENT AND TRADEMARK OFFICE

CERTIFICATE OF CORRECTION

PATENT NO. : 5,314,713

DATED : May 24, 1994

INVENTOR(S) : TAKAHIRO MORI, ET AL.

It is certified that error appears in the above-identified patent and that said Letters Patent is hereby corrected as shown below:

COLUMN 24

Line 10, "aidehyde." should read --aldehyde.--.

Signed and Sealed this

Fourteenth Day of February, 1995

Bruce Lehman

*Attest:*

BRUCE LEHMAN

*Attesting Officer*

*Commissioner of Patents and Trademarks*

--